United States Patent [19]

Degen

[11] Patent Number: 4,696,070

[45] Date of Patent: Sep. 29, 1987

[54] UNDERMATTRESS FOR RECLINING FURNITURE

[75] Inventor: Hugo Degen, Seltisberg, Switzerland

[73] Assignee: Marpal AG, Switzerland

[21] Appl. No.: 812,409

[22] Filed: Dec. 23, 1985

[30] Foreign Application Priority Data

Dec. 28, 1984 [CH] Switzerland ..... 6218/84

[51] Int. Cl.[4] ..... A47C 23/06

[52] U.S. Cl. ..... 5/238; 5/236 R

[58] Field of Search ..... 5/238, 236 R, 236 B, 5/191, 237

[56] References Cited

U.S. PATENT DOCUMENTS

| | | | |
|---|---|---|---|
| 3,813,713 | 6/1974 | Kipfer | 5/238 |
| 4,222,134 | 9/1980 | Degen | 5/191 |
| 4,251,891 | 2/1981 | Degen | 5/238 |
| 4,559,656 | 12/1985 | Foster | 5/236 R |
| 4,567,615 | 2/1986 | Fanti | 5/237 |

FOREIGN PATENT DOCUMENTS

| | | |
|---|---|---|
| 3016914 | 5/1981 | Fed. Rep. of Germany . |
| 246451 | 10/1979 | Spain . |
| 251076 | 5/1980 | Spain . |
| 273961 | 10/1983 | Spain . |
| 1385249 | 2/1972 | United Kingdom . |
| 2008939 | 11/1978 | United Kingdom . |

*Primary Examiner*—Alexander Grosz

*Attorney, Agent, or Firm*—Lahive & Cockfield

[57] ABSTRACT

A rocking cradle (2) is arranged on the inner surface of the longitudinal side section (1) of a reclining furniture frame, which rocking cradle (2) is provided with fixing members (4) for accommodating a rubber-elastic support body (5). The support body (5) in turn supports fixing members (8) for detachably fixing cross-slats (7).

The rocking cradle (2) is pivotably suspended on the longitudinal side section (1) via an axis (A) arranged in its upper center area and can therefore adapt itself to the load conditions caused by the anatomy and arising in the transitional area of the shoulder and upper rib part when a reclining person is in the side position.

5 Claims, 9 Drawing Figures

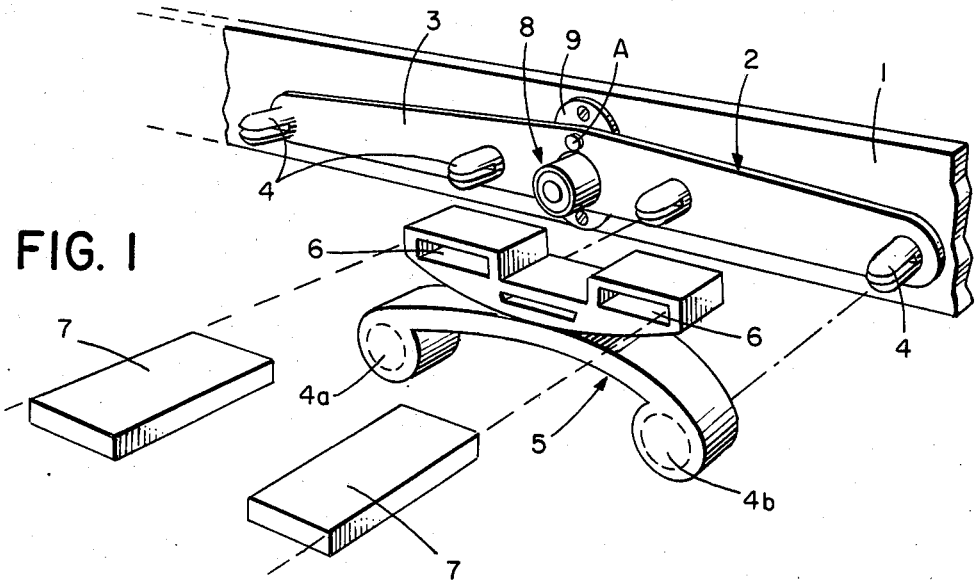
FIG. 1
FIG. 2
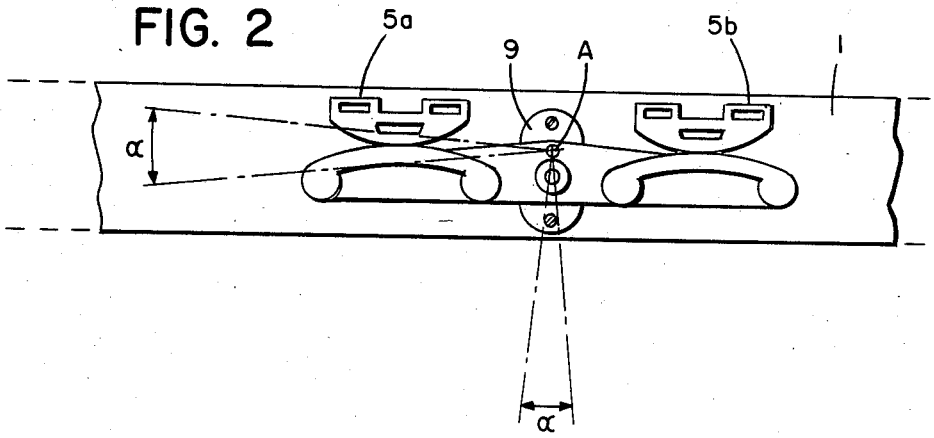
FIG. 3
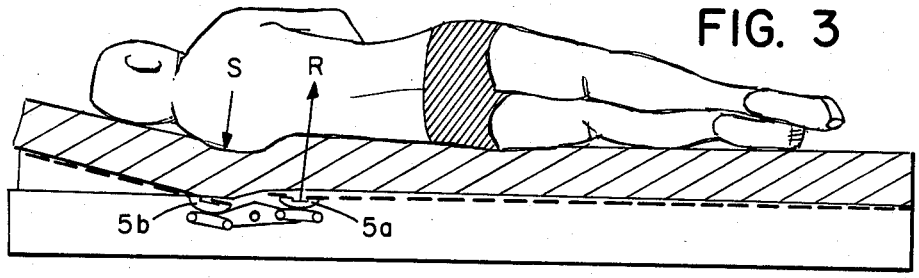

UNDERMATTRESS FOR RECLINING FURNITURE

The invention relates to an undermattress for reclining furniture, having a frame which is equipped with spring bridges which are mounted at preselected distances in the longitudinal side sections of the frame and which have in turn in each case at least one cross-slat.

As known, man continually changes his position during sleep, so that one moment he comes to lie on his back and the next moment he comes to lie on his side. However, in consideration of the human anatomy, the side position places quite different demands than the back position on the support of the reclining surface. Whereas an essentially flat support having an appropriate neck support to even out the transition from the neck to the head satisfies the person lying on his or her back, the side profile of the reclining person is much more complicated: an arched-in upper rib part adjoins an outwardly projecting shoulder, which, with regard to a physiologically correct support, should both not only be in contact with the reclining surface but also still need to be adequately supported during changes in position.

An elastic suspension of slats in a slatted frame is known from the German Offenlegungsschrift No. 2 536 898, the one-piece elastic support body of which, provided with a reinforcing insert, is rigidly fixed at its lower part to the longitudinal side section of the reclining furniture frame by means of two fixing members. At the same time, the articulated locations achieved by reductions in cross-section permit load-dependent swivelling. On the one hand, these support bodies are fixed on the reclining furniture frame without regard to certain body locations to be specially supported, so that their arrangement at the correct location of the shoulder-rib area is left to chance. On the other hand, the rigid fixing of the support body lower part at the reclining furniture frame, in interaction with the rubber-elastic articulation locations arranged above the fixing, results in a relatively small deflection angle which is limited on both sides by rigid stops. The adaptability of this known system to the anatomy in the shoulder-rib transitional area is therefore not possible and is also not even intended.

It is the object of the present invention to propose an undermattress which permits automatic adaption to the anatomical body shape in the transitional area of the shoulder and upper, side rib part and thus ensures comfortable reclining even in the side position.

The invention is defined in the independent patent claim 1. Preferred embodiments follow from the dependent patent claims.

The following description serves to illustrate an illustrative embodiment of the invention, together with some design variants.

FIG. 1 is a perspective representation of the connecting location of a spring bridge on the longitudinal side section of a reclining furniture frame.

Figure 4:
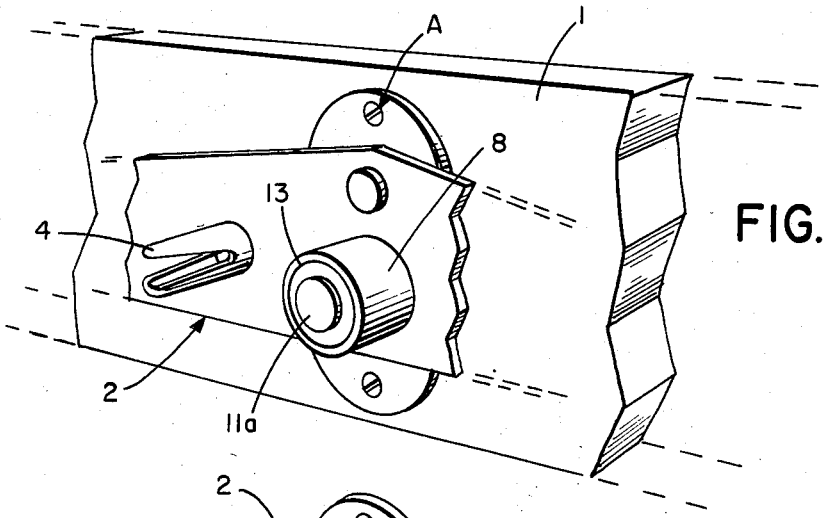
Figure 6:
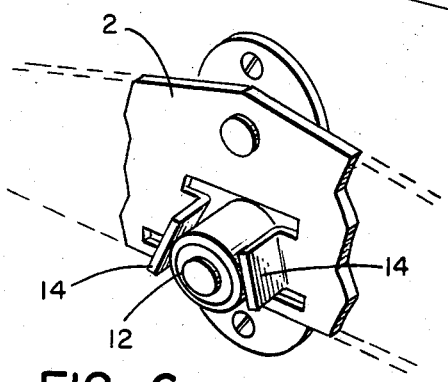
Figure 5:
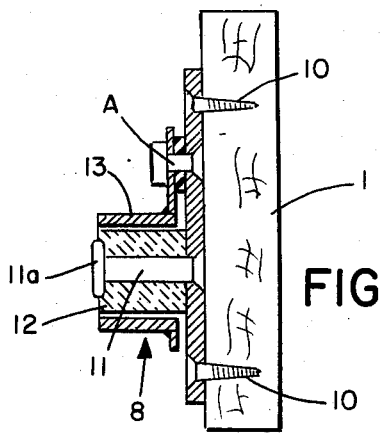
Figure 8:
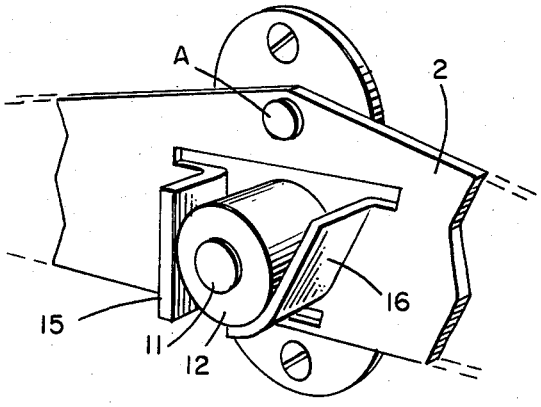
Figure 7:
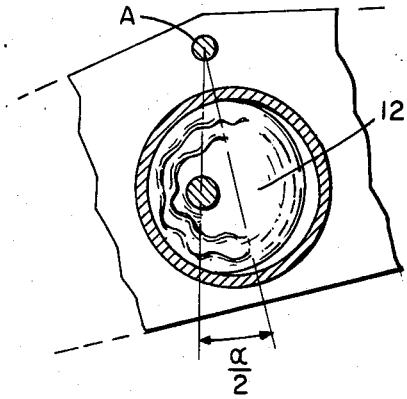
Figure 9:
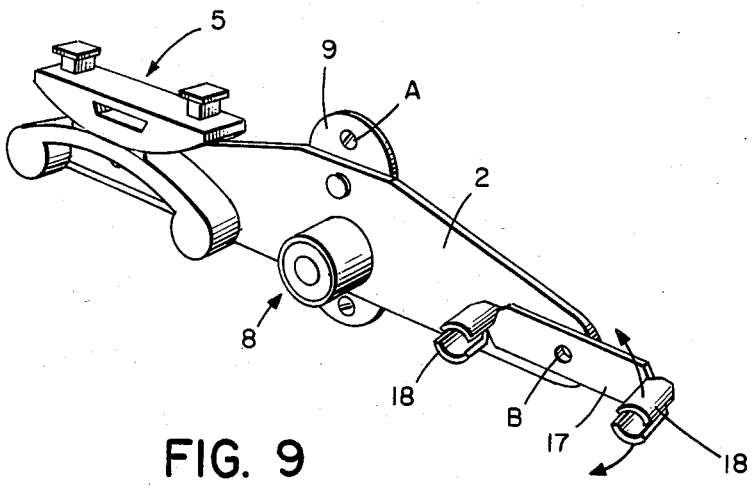

FIG. 2 is a plan view of the inner side of a longitudinal side section with the spring bridge removed, FIG. 3 shows the function of the undermattress at the transitional area of shoulder/upper rib part, FIG. 4 shows perspectively how the rocking movement can be limited or elastically braked, FIG. 5 is a vertical section of the embodiment shown in FIG. 4, FIG. 6 shows a design variant from the embodiment according to FIG. 4, FIG. 7 shows the function of the embodiment shown in FIG. 4, FIG. 8 is a perspective representation of a further variant, FIG. 9 shows perspectively a variant from the embodiment shown in FIG. 1.

FIG. 1 shows in simplified form the longitudinal side section 1 of a reclining furniture frame, on the inner surface of which is arranged a rocking cradle designated overall as 2. The rocking cradle 2 has a rigid, preferably metal cradle spar 3 which is pivotably suspended at its upper part to the longitudinal side section 1 via an axis designated as A. Fixing pins 4 are arranged on the rocking cradle, which fixing pins 4 in each case act in pairs for fixing a rubber-elastic support body 5. The support body 5 known per se is provided in its lower part with openings **4*a*, by means of which it can be pushed on to the fixing pins 4 and held there by friction contact. Moreover, the supporting body 5 has two accommodation pockets 6 on its upper part which are used for detachably fixing cross-slats 7**. The latter are preferably designed as laminated wood springs.

As shown schematically by FIG. 3, the rocking cradle described is arranged at a location of the reclining furniture frame which corresponds as exactly as possible to the transitional area from the shoulder to the upper, side rib part. Because of the anatomically conditioned arching-out of the shoulder designated as S, the support body **5*b* is pressed downwards, as a result of which the support body 5*a* located on the same rocking cradle automatically lifts, which support body 5*a*** thus correspondingly supports the arched-in upper rib part R of the reclining person.

Since each spring bridge is held at its two ends by, in each case, one rocking cradle 2 having support bodies **5*a*/5*b*, the comments relating to FIG. 2 naturally apply to both support body pairs supporting the spring bridge. At the same time, the swivel angle $\alpha$ (FIG. 2**), about which the rocking cradle is swivelled, can be quite different on both sides of the spring bridge, but will generally show at least approximately the same deflection.

The detailed representation to an enlarged scale according to FIG. 4 shows the centre area of the rocking cradle at the inner surface of the longitudinal side section 1. To limit the rocking motion of the rocking cradle on the one hand and elastically absorb it on the other hand, a stabiliser is provided which is designated overall as 8 and is shown in section in FIG. 5. The axis A of the rocking cradle on the one hand and a pin 11 on the other hand are firmly anchored in a base plate 9 which is fixed by means of screws 10 in the longitudinal side section 1. A rubber-elastic ring 12 is located on the periphery of the pin 11 made with a head **11*a*, which rubber-elastic ring 12 practically fills the annular space between the pin 11 and a circular/cylindrical sleeve 13 integrally formed on the rocking cradle 2. The pin 11 and the sleeve 13 consist of a rigid material, for example a metal, whereas the ring 12** itself is made of a rubber-elastic material, for example a wear-resistant plastic.

During rocking motion of the rocking cradle 2, which rocking motion is caused by loading on one side, the rubber-elastic ring 12 is also subjected to forces acting on one side, so that it is deformed and pressed by these forces against the inner wall of the sleeve 13. However, since the rubber-elastic ring 12 is connected rotationally rigid to the pin 11, an elastic restoring force is consequently produced which acts on the rocking cradle 2 and is felt as a comfortable support by the reclining person.

FIG. 7 illustrates the one-sided deformation of the rubber-elastic ring 12 when the rocking cradle swivels about the angle $\alpha/2$. In this connection, the rubber-elastic ring 12 exercises the function of a restoring spring, but acts at the same time as a variable limitation for the angular deflection of the rocking cradle.

The stabiliser principle explained with reference to FIGS. 4, 5 and 7 can of course be modified in manifold manner by a person skilled in the art. FIG. 6 shows a possible variant, with reference numerals introduced with reference to FIGS. 4 and 5 having been maintained. Differing from the described embodiment, the rocking cradle 2 according to FIG. 6 is not provided with a circular/cylindrical sleeve but with two brake-shoes 14 projecting outwards from the main plane of the rocking cradle. These brake-shoes therefore sit on the periphery of the rubber-elastic ring 12 and essentially have the same restoring function as the sleeve 13 shown in FIGS. 4 and 5.

FIG. 8 shows a further design of this embodiment shown in FIG. 6. Here, too, two brake-shoes 15 and 16 again sit on the periphery of the rubber-elastic ring 12, but are shaped differently. Whereas the brake-shoe 15 sits on the periphery of the ring 12 with a practically flat surface, the brake-shoe 16 partly grips around the circular/cylindrical peripheral surface of the ring 12, so that the contact surfaces of the two brake-shoes on the ring 12 deviate considerably from one another. When the ring 12 in this embodiment is only pushed loosely onto the pin 11, it will turn about its axis in the course of time under the effect of the repeated stresses, so that a practically uniform wear results on the periphery of the ring 12.

As also shown by FIG. 9, the inventive idea, differing from the embodiment shown in FIG. 1, can also be put into effect in another way. In this variant, the rocking cradle 2 which is also pivotably suspended here about its axis A has on each of its arms a further rocking cradle which is designated as 17 and is in turn provided with fixing members 18 for accommodating a rubber-elastic support body 5. In this embodiment, the support bodies 5 in addition to their inherent elasticity, can also swivel about the respective axis, designated as B, and thus adapt further to the anatomical conditions.

I claim:

1. Undermattress for reclining furniture, having a frame which is equipped with spring bridges which are mounted at preselected distances in the longitudinal side sections of the frame and which have, in turn in each case, at least one cross-slat, further having adjustable supporting means arranged between a head part and a body support part of said undermattress wherein the said supporting means comprises two rigid rocking cradles (2) which are arranged at the inner surfaces of said longitudinal side sections (1) each of which is at a central location pivotably suspended about a swivel axis (A) which runs transversely to the longitudinal axis of the reclining furniture at the transitional area from the shoulder (S) to the upper rib part (R) of a reclining person and which said axis is located in the upper cradle area, and wherein each said rocking cradle carries at its two ends a pair of support bodies (5*a*, 5*b*) which accommodate said spring bridges for supporting the shoulder part and the upper, side rib part of the reclining person in its side position.

2. The undermattress according to claim 1, wherein said rocking cradle (2), is connected to the adjacent longitudinal side section (1) of said reclining furniture frame by a rubber-elastic brake member (8) in order to limit and/or elastically brake the angular deflection of said rocking cradle (2).

3. The undermattress according to claim 2, wherein said brake member (8) has a rubber-elastic ring (12) arranged on said adjacent longitudinal side section (1) of said reclining furniture frame, on the outer surface of which said ring (12) sits at least one friction member (13, 14–16) integrally formed on or fixed to said rocking cradle.

4. The undermattress according to claim 3, characterized in that said rubber-elastic ring (12), in its area projecting beyond said rocking cradle (2) is enclosed by a friction sleeve (13) which is rigidly connected to said rocking cradle and encircles said rubber-elastic ring (12) on all sides.

5. The undermattress according to claim 4 wherein each arm of said rocking cradles have two mounting pins (4) for accommodating a rubber-elastic support body (5) which in turn has fixing members (6) for the detachable fixing of at least two cross-slat ends (7).

* * * * *